US008209770B2

(12) United States Patent
Page et al.

(10) Patent No.: US 8,209,770 B2
(45) **Date of Patent: *Jul. 3, 2012**

(54) SPECTRALLY BALANCED PROTECTIVE FACEMASKS

(75) Inventors: Christopher S. Page, Portland, OR (US); Alan W. Reichow, Beaverton, OR (US); Karl M. Citek, Hillsboro, OR (US)

(73) Assignee: Nike, Inc., Beaverton, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/876,858

(22) Filed: Sep. 7, 2010

(65) Prior Publication Data

US 2011/0000007 A1 Jan. 6, 2011

Related U.S. Application Data

(63) Continuation of application No. 11/067,477, filed on Feb. 24, 2005, now Pat. No. 7,814,577.

(51) Int. Cl.
*A61F 9/00* (2006.01)

(52) U.S. Cl. ..... 2/12; 2/15; 2/9

(58) Field of Classification Search ..... 2/9, 15, 2/425, 12, 10, 6.3, 6.4, 6.7, 424
See application file for complete search history.

(56) References Cited

U.S. PATENT DOCUMENTS

| | | | | | |
|---|---|---|---|---|---|
| 5,066,529 | A * | 11/1991 | Huber et al. | 428/41.6 |
| 5,098,180 | A * | 3/1992 | Tobey | 351/97 |
| 5,603,117 | A * | 2/1997 | Hudner et al. | 2/6.6 |
| 5,946,071 | A * | 8/1999 | Feldman | 351/41 |
| 6,115,843 | A * | 9/2000 | Travalgia | 2/171 |
| 6,874,888 | B1 * | 4/2005 | Dudai | 351/162 |
| 7,195,350 | B2 * | 3/2007 | Kurzrok | 351/45 |
| 7,814,577 | B2 * | 10/2010 | Page et al. | 2/245 |
| 2002/0069449 | A1 * | 6/2002 | Blutstein et al. | 2/202 |
| 2002/0088043 | A1 * | 7/2002 | Cook | 2/9 |
| 2004/0010833 | A1 * | 1/2004 | Heine et al. | 2/12 |
| 2004/0199972 | A1 * | 10/2004 | Rickon | 2/9 |
| 2006/0053521 | A1 * | 3/2006 | Rickon, Jr. | 2/9 |

* cited by examiner

*Primary Examiner* — Shaun R Hurley
*Assistant Examiner* — Andrew Sutton
(74) *Attorney, Agent, or Firm* — Shook, Hardy & Bacon L.L.P.

(57) ABSTRACT

Protective eyewear is configured so that interior surfaces are associated with visual characteristics based on a use environment. Eyewear includes an interior surface having two or three horizontal zones that are assigned colors, gray levels, color coordinates, or other characteristics based on playing surface characteristics. Upper, middle, and lower interior portions can be associated with blue, green, and brown, respectively.

17 Claims, 4 Drawing Sheets

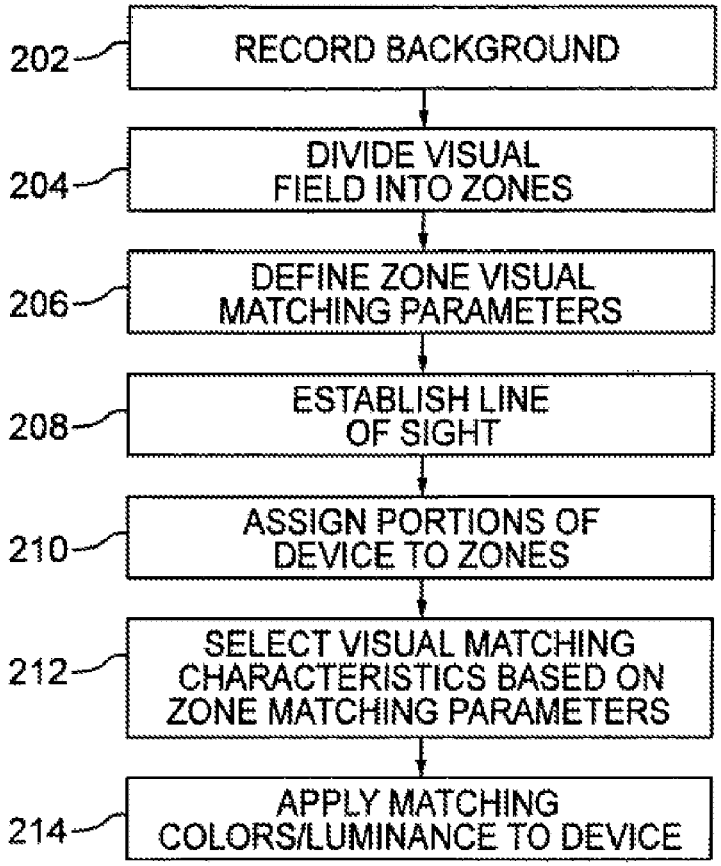
FIG. 2
FIG. 3
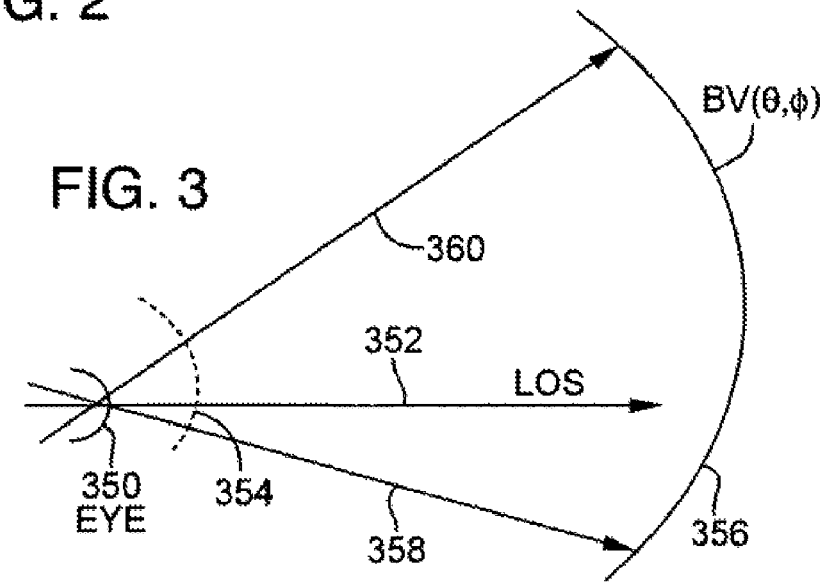

SPECTRALLY BALANCED PROTECTIVE FACEMASKS

CROSS-REFERENCE TO RELATED APPLICATIONS

This application is a continuation of U.S. patent application Ser. No. 11/067,477 now U.S. Pat. No. 7,814,577, filed Feb. 24, 2005, the entirety of which is incorporated by reference herein.

TECHNICAL FIELD

The disclosure pertains to protective eyewear for sports and other activities.

BACKGROUND OF THE INVENTION

Individuals engaging in team or individual sports frequently use protective headgear or eyewear to reduce the likelihood of injury. Some well known examples of such protective headgear include baseball or softball catcher's masks, and helmets with and without face shields such as helmets adapted for use in baseball, softball, snowboarding, hockey, and football. Other recreational and athletic activities in which protective headgear is common include boxing, cycling, rock climbing as well as motorized recreational activities such as motorcycling and dirt biking. In some activities, protective headgear is viewed as unnecessary and protective eyewear is used. Typical activities in which protective eyewear is used include basketball, shooting, and squash. Similar protective equipment is often used in other activities as well. For example, welding masks and goggles are in widespread use, and helmets are often used by workers in construction and law enforcement. In addition, protective gear is in common use by military personnel.

While protective gear is effective is reducing both the number and severity of injuries, most wearers would prefer to do without. Protective gear is often viewed by its wearers as uncomfortable and cumbersome. In addition, many users of protective gear believe that their vision is diminished, because the user must often look through a protective mesh or shield, or a portion of the user's field of view is completely blocked by the protective gear. Thus, individuals typically use protective gear reluctantly, and in some cases, user performance at athletic, industrial, military, or other tasks can be noticeably degraded.

In view of these and other shortcomings, improved protective gear and methods for making such gear are needed.

BRIEF SUMMARY OF THE INVENTION

Protective headgear comprise a face shield having an exterior surface and an interior surface. The interior surface includes one or more zones that are matched to visual characteristics of a use environment. For example, for an interior surface having two zones, the first zone and the second zone are associated with a first visual characteristic and a second visual characteristic of the use environment, respectively. In representative examples, the first visual characteristic and the second visual characteristic are associated with a first gray level and a second gray level, respectively, or a first color coordinate and a second color coordinate, respectively. In other examples, the first visual characteristic and the second visual characteristic are associated with a first color and a second color, respectively. According to representative examples, the interior surface includes a third zone associated with a third visual characteristic, and the first, second, and third visual characteristics are associated with brown, green, and blue, respectively. In additional examples, the first, second, and third zones are substantially horizontal in an as-worn position. In further examples, at least a portion of an interior surface of a shell configured to be worn on a user's head is associated with at least one of the first zone and the second zone. In other representative examples, the first zone and the second zone are substantially vertical in an as-worn position. In other examples, the exterior surface includes a first zone and a second zone associated with the visual characteristics of the first zone and the second zone of the interior surface, respectively, or is associated with an exterior visual characteristic. In an example, the exterior visual characteristic is associated with skin tones.

Face shields comprise a frame that includes at least a first zone and a second zone. An interior surface of the first zone and an interior surface of the second zone are associated with a first visual characteristic and a second visual characteristic, respectively. In representative examples, the first zone is situated below the second zone in an as-worn position. In other examples, a third zone has an interior surface, wherein the interior surfaces of the first, second, and third zones are associated with visual characteristics based on a playing field for a sport.

Eyewear comprise a lens frame configured to receive lenses. At least first and second portions of an anterior surface of the lens frame are associated with a first visual characteristic and a second visual characteristic. In some examples, the first and second visual characteristics are different colors. In additional examples, the first and second portions extend substantially horizontally in an as-worn position. In further examples, the visual characteristics are different gray levels. In additional examples, the eyewear also include first and second temples, wherein at least portions of the first and second temples are associated with at least one of the first and second visual characteristics. In additional examples, the lens frame is configured so that the first zone and the second zone are fixed in predetermined portions of a wearer's field of view in an as-worn position.

A treatment kit for a face shield comprises at least a first colorant and a second colorant, wherein the first colorant and the second colorant are associated with a use environment. In additional examples, the kit includes a template configured to define a first zone to receive the first colorant and a second zone to receive the second colorant. In further examples, the kit comprises a third colorant, wherein the template is configured to define a third zone configured to receive the third colorant, and wherein the first, second, and third zones are associated with a baseball field.

Methods include assigning background visual values to a portion of a field of view and associating the background visual values with portions of a visual obstruction. A visual appearance of at least a portion of the visual obstruction is configured based on the associated background visual values. In some examples, the background visual values are based on measurements of at least one use environment. In additional examples, the background visual values are assigned to the portions of the visual obstruction by defining zones on the visual obstruction. In other examples, the visual appearance is configured based on associating visual characteristics of the zones with visual characteristics of the background.

Methods of compensating a visual obstruction include associating portions of an interior of the visual obstruction with a background, and assigning visual characteristics to the portions of the interior based on the associated background. In representative examples, the portions of the interior are an upper portion, a middle portion, and a lower portion. In additional representative examples, the assigned visual characteristics are gray levels or colors. In further examples, the interior of the visual obstruction is treated based on the assigned visual characteristics.

These and other features and advantages are described below with reference to the accompanying drawings.

BRIEF DESCRIPTION OF THE DRAWINGS

The present invention is described in detail below with reference to the attached drawing figures, wherein:

FIG. 2 is a schematic block diagram of a method of visually correcting or compensating a face shield or other visual obstruction.

FIG. 3 is a representative mapping of portions of an interior surface of a face shield or other visual obstruction to a background.

DETAILED DESCRIPTION OF THE INVENTION

Disclosed below are representative methods and apparatus. The disclosed methods should not be construed as limiting in any way. Instead, the present disclosure is directed toward novel and nonobvious features and aspects of the various disclosed embodiments, alone and in various combinations and subcombinations with one another. The methods and apparatus are not limited to any specific aspects or features, or combinations thereof, nor do the methods and apparatus require that anyone or more specific advantages be present or problems be solved.

Although the operations of the disclosed methods and apparatus are described in a particular, sequential order for convenient presentation, it should be understood that this manner of description encompasses rearrangement, unless a particular ordering is required by specific language set forth below. For example, operations described sequentially may in some cases be rearranged or performed concurrently. Moreover, for the sake of simplicity, the disclosed flow charts typically do not show the various ways in which the disclosed methods can be used in conjunction with other methods. Additionally, the detailed description sometimes uses terms like "determine" and "provide" to describe the disclosed methods. These terms are high-level abstractions of the actual operations that are performed. The actual operations that correspond to these terms will vary depending on the particular implementation and are readily discernible by one of ordinary skill in the art.

Representative examples are presented below with reference to protective gear for baseball, but visual obstructions associated with protective gear, protective screens and shields, eyeglasses, and other devices used in other sporting, recreational, industrial, commercial, medical, military, and other activities can be similarly configured.

Examples of protective gear as described herein can be configured as eyeglasses, goggles or other eyewear, face masks such as catcher's masks, helmets for football, hockey or other activities that can include a face mask portion.

Figure 1A:
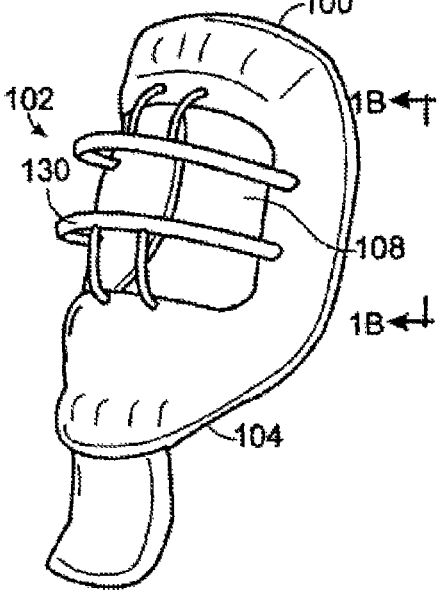
FIGS. 1A-1B are a front view and a rear view, respectively, of a catcher's mask.
Figure 1B:
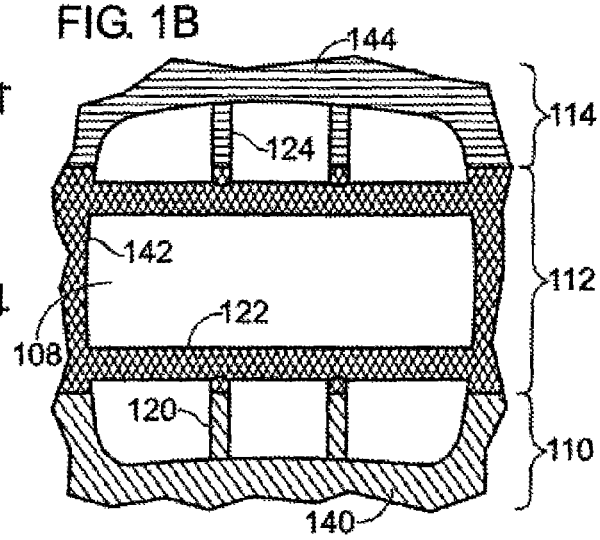

With reference to FIGS. 1A-1B, a catcher's mask 100 includes a face shield 102 and one or more perimeter pads such as a perimeter pad 104. Typically, the catcher's mask 100 includes one or more elastic support straps (not shown in FIGS. 1A-1B) that are configured to be adjustable by the catcher so that the perimeter pad 104 is pressed against the catcher's face to hold the mask 100 in position during use. The face shield 102 includes a grillwork that is configured to stop penetration of a baseball, thereby protecting the catcher's face.

The face shield 102 can be divided into two, three, or more portions and any visual obstruction perceived by the wearer can be eliminated or reduced by coloring or shading each of these portions appropriately. For example, a catcher wearing the mask 102 typically positions his head so that the pitcher and eventually the pitch are viewed through a central slot 108. In this as-worn position, a lower portion 110 of the face shield is viewed against a playing field background associated with a playing surface that can include natural grass or artificial turf, and dirt. In a typical example, the lower 15 portion 110 is primarily viewed against a dirt background. A central portion 112 of the face shield 102 is situated to be viewed against the playing field background, typically against natural or artificial turf. An upper portion 114 of the face shield is viewed against another portion of the playing field background, typically background portions above the playing surface such as, for example, clouds, blue sky, a stadium dome or cover, or bleachers or stadium seating (occupied or unoccupied by fans). In other examples, the upper portion 114 is generally viewed against a center field portion of stadium seating or other structures such as scoreboards, advertising, or other signs or structures placed in a center field region. For any particular catcher's mask, catcher, and playing field, the position of these and other backgrounds with respect to the catcher's mask in the as-worn position can be estimated or measured or otherwise characterized. Alternatively, an average or typical background can be associated with a catcher's mask based on an average or typical orientation of the mask as worn.

In the example of FIGS. 1A-1B interior surfaces 120, 122, 124 of the portions 110, 112, 114, respectively, are colored, painted, or otherwise configured based on a selected background against which the portions 110, 112, 114 are viewed with the catcher's mask in an as-worn position. Such portions and other surfaces that face a wearer's eyes are referred to herein as interior or posterior surfaces. It is generally convenient to configure the interior surfaces 120, 122, 124 to visually approximate the appropriate backgrounds. Such visual approximation can include selectively painting, dyeing, staining, coating, or otherwise configuring the interior surfaces 120, 122, 124 to approximate selected background visual characteristics based on, for example, background spectral reflectance, background hue, intensity, and/or value to obtain, for example, selected values of hue, value, and intensity. Reflectances can be conveniently described as functions of wavelength over a wavelength range, or alternatively, spectral reflectances can be described using color coordinates such as, for example, CIE tristimulus values X, Y, Z (or related values x, y, z), CIE uniform color space coordinates L, a, b, or other color coordinates or color representations. Typically, the interior surfaces 120, 122, 124 are configured to approximately match the selected background colors. However, the interior surfaces of the face shield 102 do not directly receive illumination that is received by a playing surface or playing field, and in the as worn position typically appear darker than if exposed to ambient illumination directly.

Therefore, a relative brightness of a particular portion of an interior surface can be increased in order to better visually match a background.

An exterior surface 130 of the face shield can be conveniently divided into portions associated with the interior surfaces 120, 122, 124 and similarly decorated or colored. (Such exterior surfaces can also be referred to as anterior surfaces). This can be especially convenient as it permits the catcher to determine how the mask 100 is configured without looking at the interior surfaces or putting the mask 102 on. In some cases, a catcher may elect to acquire several masks, adapted for different backgrounds associated with different playing surfaces, stadiums, weather conditions, type of turf, the expected presence or absence of fans, or based on other variables.

Because the exterior surface 130 is not generally noticeable to the catcher with the mask 102 in the as-worn position, the exterior surface 130 can be otherwise colored or decorated. For example, the exterior surface can be configured to approximately match catcher flesh tones for convenience in observing the catcher's face with reduced visibility of the face mask. Alternatively, a team logo or other decorative graphic can be applied, and such a graphic can be used by a pitcher to determine that the catcher is ready to receive a next pitch.

While the face shield 102 is often a major contributor to the catcher's visual impairment, other portions of the catcher's mask 100 can also be visually distracting. For example, pad interior surfaces 140, 142, 144 are also viewable by the catcher. Portions of the pad can be colored similarly to the interior surfaces of the face shield so that the pad is less noticeable to the catcher, thereby permitting the catcher to remain attentive to the play of the game.

Referring to FIG. 2, a method for selecting interior coloring for a protective face shield such as the face shield 102 includes recording, measuring, or estimating a background in a step 202. In a step 204, a visual field is divided into one or more zones, or a background is otherwise characterized as a set of values or based on continuously varying values. In a step 206, visual matching parameters are selected for one or more of the zones, or a continuous visual mapping function is defined. In a step 208, an as-worn line of sight (LOS) of the face shield is established, and in a step 210, portions of at least an interior surface of the face shield are mapped to background zones or associated with background regions. Such mapping can be based on a few background regions, or the entire face shield interior can be continuously mapped onto a background surface. In a step 212, visual matching characteristics are selected for at least some portions of the face shield interior.

The background surface can be associated with one or more visual coordinates, typically colors, shades of gray, or one or more color coordinates such as hue, saturation, and value or other color coordinates. These visual properties can be assigned or associated with one or more surface regions of the background surface, so that the background surface is defined by a few such visual coordinates or a few sets of such visual coordinates. Alternatively, the background surface can be associated with continuously varying color coordinates. Typically an interior surface of protective gear such as a catcher's mask receives less illumination than a surrounding playing surface, and at least some portions of the interior surface is assigned a color that is lighter than the associated background when illuminated by the same source. Such assignments can be based on such factors as time of day, location of playing surface, and wearer's skintone, so that different interior colors or shades are preferred at different times of day and/or seasons of the year and/or for different wearers.

With the face shield interior mapped to the background surface, matching colors are applied to portions of the face shield in step 214. For example, the interior surface can be colored, stained, dyed, coated, or otherwise treated or processed in accordance with the selected color coordinates or visual properties obtained from the background. Typically, at least the interior of the face shield is processed to match or approximately match the selected visual properties or color coordinates in at least one region. While most applications involve matching or approximately matching a surface appearance of a visual obstruction to a background, in some examples, a contrary approach can be followed, and the interior of the face shield treated to heighten the contrast of the obstruction. Such treatment can be used, for example, to provide an indication to the wearer that the obstruction is aligned with a predetermined axis, such as in a training regimen for head and body posture and orientation. Such contrast enhancement can also be applied to visual indicators such as reticles or other sighting devices or alignment devices.

Mapping of portions of a face shield or other device situated in a user's field of view is illustrated in FIG. 3. A user's eye 350 is positioned with respect to the face shield 354 and a typical "as-worn" line of sight (LOS) 352 is established. A surface 356 having background visual values (BVVs) based on an anticipated use environment is arranged with respect to the face shield 354 and the LOS 352 so that BVVs can be associated with respective portions of the face shield 354. The BVVs can be obtained by, for example, measurements of one or more use environments (such as playing surfaces or stadiums for sporting uses) including time of day, weather, and other actors. Such measurements can be obtained using a video camera or still camera and estimating color coordinates based on red, green, and blue components of acquired images. Alternatively, a spectrometer, color meter, or other measurement device can be used, or color samples can be visually matched by one or more individuals.

Figure 4A:
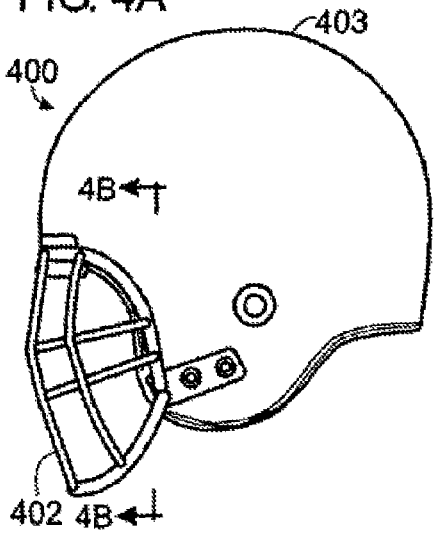
FIGS. 4A-4B are a front view and a rear view, respectively, of a football helmet.
Figure 4B:
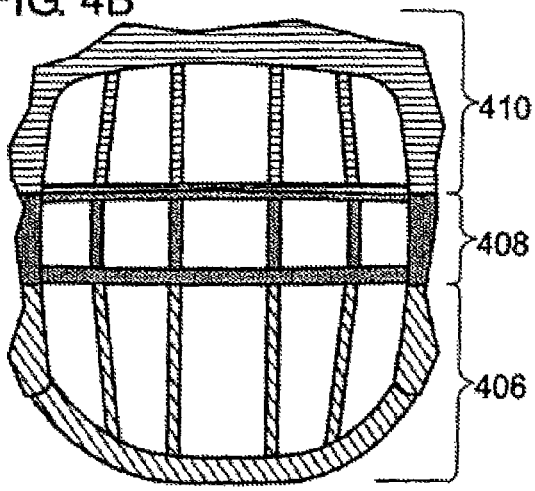

FIGS. 4A-4B illustrate an exterior and an interior, respectively, of a football helmet 400 that includes a face guard 402. The face guard 402 includes a lower zone 406, a middle zone 408, and an upper zone 410. Interior surfaces of the various zones can be selected based on anticipated backgrounds and lighting conditions for a selected as-worn line of sight (LOS). The LOS can vary considerably for wearers at different positions of play. For example, with the helmet tilted at a forward or downward angle, a typical LOS for a football lineman will be in the upper third of the facemask, while a LOS for a defensive back or wide receiver may be at or above the vertical midline of the facemask with the helmet upright or tilted slightly backward.

Figure 4C:
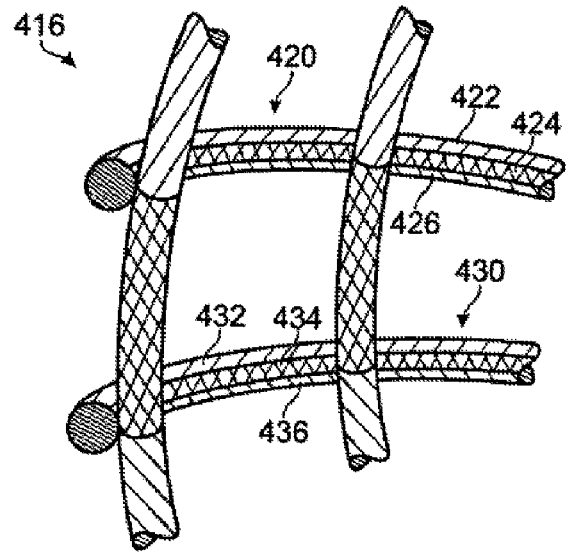
FIG. 4C is a view of a portion of a face mask for a football helmet.

FIG. 4C illustrates an additional example faceguard 416 that includes a lower zone, a middle zone, and an upper zone in a manner similar to that of the face guard 402 of FIG. 4B. A representative face guard crossbar 420 includes upper, middle, and lower portions 432, 434, 436, respectively. As shown in FIG. 4C, the crossbar 420 is assigned to a single zone, but the portions 432, 434, 436 are assigned differently colors, tints, hues, values, or other visual parameters in accordance with anticipated illumination conditions. For example, the upper portion 432 can receive direct illumination from stadium lights or the sun, while the lower portion receives illumination that is reflected from a playing surface. A middle portion 434 receives illumination from both the playing surface and stadium light or sunlight. Because the illumination reaching the lower portion 436 is typically less intense than that reaching the upper portion 432, a somewhat darker shade can be applied to this crossbar portion. While discrete portions of the crossbar 420 are assigned particular visual characteristics in FIG. 4C, graded visual characteristics can be applied so that, for example, shading gradually varies from darker on a top crossbar portion to lighter on a bottom crossbar portion. A variety of visual characteristics can be varied, including total reflectance, spectral reflectance, or other visual characteristic. Because at least some illumination reaching the face guard is reflected from the wearer's skin, skin tone can be a factor in selecting visual characteristics.

Figure 5A:
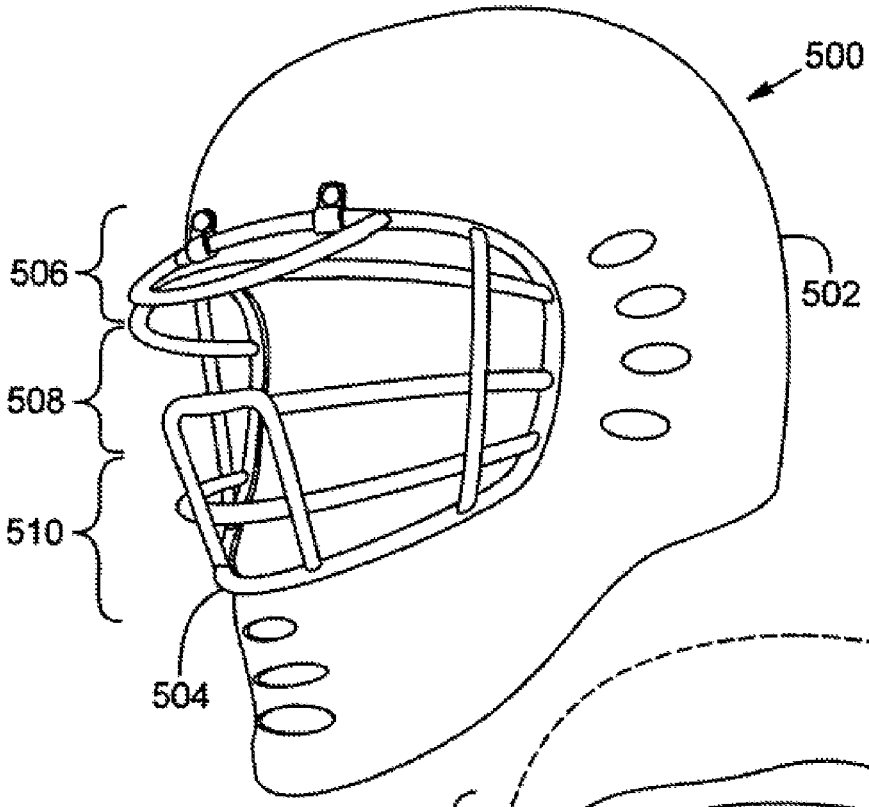
FIGS. 5A-5B are a front view and a rear view, respectively, of a catcher's helmet.
Figure 5B:
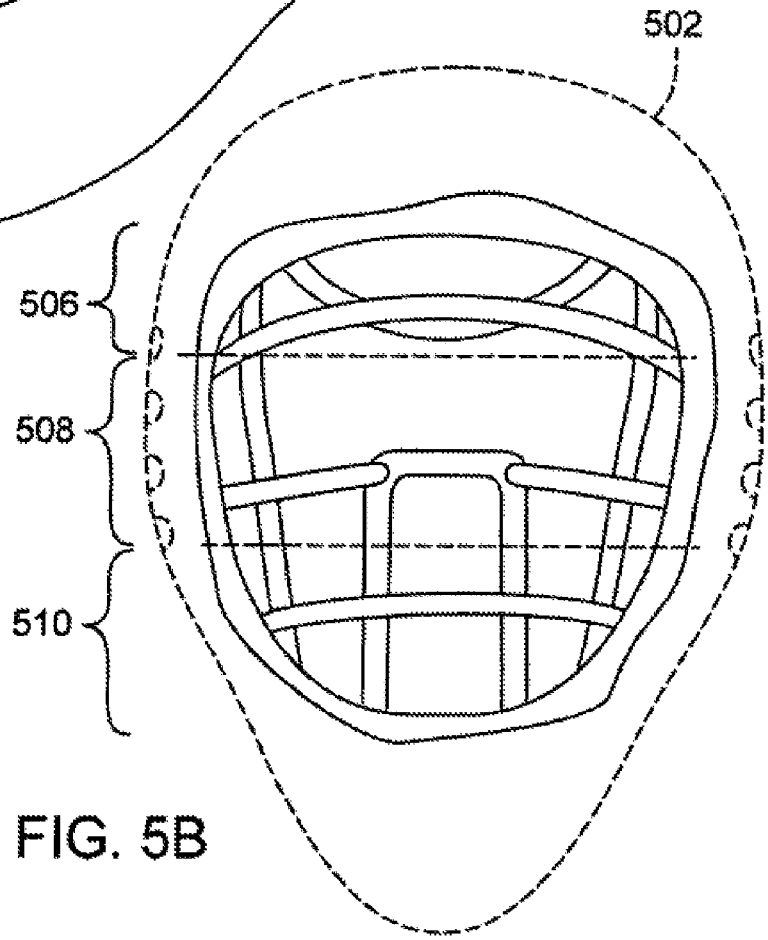

FIGS. 5A-5B illustrate an exterior and interior, respectively, of a catcher's helmet 500 that includes a protective shell 502 and a face shield 504. An upper zone 506, a central zone 508, and a lower zone 510 are defined, and interior portions of these zones are assigned colors or are otherwise visually matched to a background. An exterior of the face shield 502 can be decorated with, for example, a team logo, colored to visually match the catcher's face, or otherwise configured.

In the examples above, a visual field is divided into three horizontal zones, and color matching or other visual correction or compensation is applied to one or more of the interior facemask surfaces described by these zones. In other examples, these interior zones can be vertical, horizontal, or a gridwork, or other arrangement of zones can be used. Facemask visual compensation (PVC) can be configured based on spectral reflectances of interior facemask surfaces illuminated either directly from one or more external ambient sources and/or indirectly by reflected light from the wearer's face and/or inside helmet surfaces. FVC can be specified using color coordinates such as, for example, CIE tristimulus values X, Y, Z (or related values x, y, z), CIE uniform color space coordinates L, a, b, or other color coordinates or color representations.

Selection of spectral reflectances can be based on a particular illumination source for a particular stadium, or an average of several illumination sources can be used. For example, spectral distributions associated with quartz-halogen lamps, metal halide lamps, fluorescent lights, or other artificial illumination sources can be used. In addition, spectral reflectances can be selected based on natural light illumination conditions such as bright sunlight, cloud cover, snow, rain, fog, or other illumination conditions that are encountered at a particular location. For example, bright sunlight illumination may be appropriate for a sunny climate, while cloud cover may be appropriate for rainier climates. However, spectral reflectances can also be selected based on an average illumination for use in a variety of illumination conditions.

Spectral reflectances of the interior facemask surfaces can vary in color and/or brightness based on such factors as the size, shape, contour, orientation, pattern, and location with respect to the wearer's eyes of the gridwork arrangement and its individual components. Depending on the shape of the individual component of the gridwork, such as, for example, round or elliptical, spectral reflectances also can vary, in a gradient or discrete manner, from the interior facemask surface toward the exterior facemask surface. For example, for a horizontal round barjust below the wearer's LOS, the uppermost portion can be darker and the lowermost portion can be lighter than the interior surface closest to the wearer's eyes. Similar analyses can be applied to horizontal bars at other locations, as well as vertical and oblique bars, as well as bars of other shapes and sizes.

In an example, color selection and characterization can be conveniently described based on a CIE L-a-b Color Space. A Total Color Difference (TCD) between colors having coordinates $(L_1, a_1, b_1)$ and $(L_2, a_2, b_2)$ in such a color space can be defined as $TCD=\sqrt{(a_1-a_2)^2+(b_1-_2)^2+(L_1-L_2)^2}$. A Color Difference (CD) under isoluminant conditions, i.e., assuming identical brightnesses of the colors, can be defined as $CD=\sqrt{(a_1-a_2)^2+(b_1-b_2)^2}$. Compensating interior colors or gray levels can be selected based on TCD, CD, or on other coordinates. Because interior surfaces receive different illumination, as described above, TCD-based matching generally provides superior results. In representative examples, TCD can be less than about 15 or CD can be less than about 10. In examples where the visual difference is heightened between the facemask and the background, TCD can be more than about 15 or CD can be more than about 10. As an example, the differences in spectral reflectances of average samples of green grass and brown dirt have TCD of about 21 and CD of about 15; an FVC intended to match green grass can have TCD and CD values much less than these.

In another example, luminance contrast is selected for compensation. Luminance contrast can be calculated using a spectral reflectance function SRF(λ) (reflectance as a function of wavelength λ) of an object with respect to a particular light source. For the examples presented herein, a light source having a spectral distribution D65(λ) and similar to sunlight is used. In addition, a human spectral sensitivity function HSSF(λ) is used. A luminance coordinate L can be calculated as:

$$L=\frac{\int SRF(\lambda)D65(\lambda)HSSF(\lambda)d\lambda}{\int D65(\lambda)HSSF(\lambda)d\lambda}.$$

Luminance contrast for objects having luminances $L_1$ and $L_2$ can be calculated as $|(L_1-L_2)|/L_1|$, wherein $L_1>L_2$.

FVC can be configured based on colors or shades that are substantially similar as shown on, for example, a CIE plot. In some color representations, equal separations as graphed do not correspond to equal or even approximately equal perceived color differences. For example, so-called MacAdam ellipses of varying sizes and eccentricities can be used to characterize "just noticeable differences" (JND) in perceived colors as a function of coordinate location on the standard CIE chromaticity diagram. Colors can be selected for matching that are within or approximately within a MacAdam ellipse, or that are associated with a just noticeable color difference.

In a representative example, colors can be selected based on direct visual comparison using PANTONE color chips. For example, colors for an interior surface of a face shield for a catcher's mask can be selected by situating a test subject in an environment similar to an actual use environment. For example, the subject can be situated in a catcher's position on a baseball diamond and color chips placed at suitable locations in the subject's field of view so as to be observed against selected backgrounds such as; for example, dirt, grass, sky, or stadium seating. Responses from the test subject can be used to determine if colors associated with a particular chip provide an adequate match to a background. One or more test subjects can be used, and such color comparisons performed under various lighting conditions and at different baseball diamonds. Average values, individual values associated with a most difficult viewing condition, or other values can be selected based on subject responses. In a representative example, configured to day use, an upper zone of a mask interior is approximately matched to P ANTONE COOL GRAY 3U and a lower zone is approximately matched to P ANTONE 1615U BROWN. In another example, configured for evening/night game use, a top zone is approximately matched to P ANTONE COOL GRAY 11 U and a lower zone is approximately matched to 20 PANTONE 1615U BROWN. Brown shades typically are somewhat 'redder' than typical dirt samples due to materials added to baseball diamond soils. In these examples, only two interior zones are provided. Other devices such as batting helmets and football helmets can be similarly configured. In some examples, particular game/player situations are used in color selection. Abrupt color changes on interior surfaces are typically satisfactory, but gradual transitions between color zones can be provided. In addition, interior color selections can be lighter shades that those chosen based on test subject evaluations due to the limited illumination incident upon interior surfaces. Zone portions in a peripheral portion of a user's field of view can be configured based on gray levels, as peripheral vision exhibits limited color sensitivity.

Selected color coordinates or other color or gray values can serve as a guide in dye or pigment selection, and actual applied colors or shades can differ. For example, dyes, coatings, or pigments that are satisfactory with respect to durability, cost, fading, or other factors may be unavailable. In some examples, actual colors deviate from associated target color coordinates to trade-off luminance contrast or other design goals. Fluorescent agents can also be included to enhance overall luminance to compensate for lower illumination levels on interior surfaces.

Figure 6:
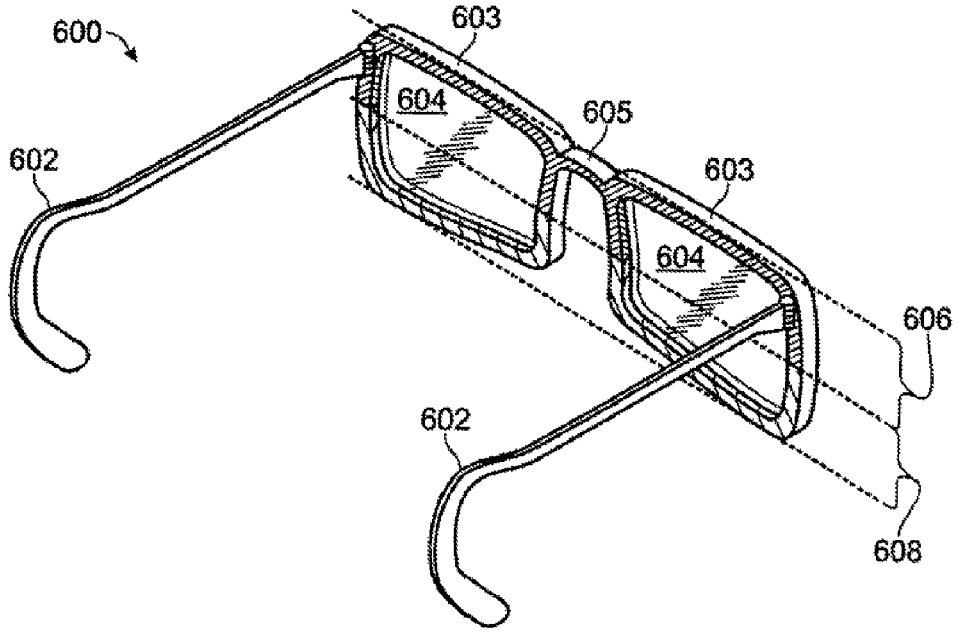
FIG. 6 is a schematic diagram of eyewear that includes a frame having a visually coordinated surface.

While examples described above are based on particular color representations, in other examples, color representations based on red-green-blue (RGB), cyan-magenta-yellow (CMY), hue-saturation-brightness (HSB), CIE XYZ, CIE xyz, CIE L a b, CIE L u v, Munsell, or other representations can be used. In addition, representative examples described above are based on configuring protective headgear for football and baseball but in other examples headgear for objects for softball, lacrosse, hockey, and other sports can be provided. Protective eyewear for other sports, occupational, military, law enforcement, or other activities can be similarly configured. With reference to FIG. 6, eyewear 600 includes temples 602, front pieces 603 that retain lenses 604, and a bridge 605. The lenses 604 can be configured as corrective or protective lenses, as sunglass lenses, for cosmetic reasons, or otherwise configured. Zones 606, 608 are defined for application of background matching. If desired, portions of the temples 602 can also be associated with one or more matching zones, and pads (not shown) that fit against sides of the nose can be also be assigned to one or more zones. For convenience, eyewear pads, front pieces, and the bridge can be referred to as a frame, and portions of the frame associated with matching zones. Protective goggles for basketball, racquetball, or other activities can be similarly configured.

Protective and other devices for a range of activities can be configured based on zones as well. For example, interior (or posterior) surfaces of military headgear can be associated with zones, even if such headgear lacks a face shield or other shield that is situated directly in the wearer's field of view. Appropriate correction or compensation of zones in a perimeter portion of a field of view reduces visual distractions presented to the wearer. Protective screens and shields such as windshields can also have zones associated with visual obstructions such as obstructions produced by perimeter or other mountings, or objects that are placed within the field of view provided by such screens or shields. Some examples including assigning and visually diminishing contrast in zones of a protective mesh situated to stop foul balls, hockey pucks, or other flying objects from injuring spectators. Viewing instruments that obstruct a portion of a field of view such as, for example, telescopes, binoculars, or rear view minors can be visually compensated as well.

For convenience, treatment of the visual appearance of a set of zones (including a continuously varying set of zones) can be referred to as visual compensation, correction, or matching. Generally, such compensation, correction, or matching is associated with reduction of apparent contrast between a visual obstruction or a visual distraction. In some examples, color matching is used, but typically one or more visual characteristics are approximately matched. Visual characteristics can be compensated based on equal brightnesses (isoluminant conditions), or based on different brightnesses for one or more zones with respect to an anticipated background. For convenience, zones are referred to as being associated with different colors or different visual characteristics. Such characteristics can be associated with one or more color coordinates such as CIE x-y-z or other coordinates, a gray level, hue, saturation, value, or other characteristic. For example, different zones that appear to have different values of neutral gray can be referred to as differently colored. Alternatively, in other examples, zones are selected for contrast enhancement by, for examples, selecting complementary colors or by selecting substantially different color coordinates, or gray levels.

Face shields and other obstructions can be conveniently treated based on assigned visual characteristics, gray levels, colors, or color coordinates by painting, staining, dyeing, or applying one or more coatings. A template can be provided on which zones are defined in order to guide treatment.

It will be apparent that the examples described above can be modified in arrangement and detail without departing from the scope of the disclosure. These examples are not to be taken as limiting, and we claim all that is encompassed by the appended claims and equivalents.

We claim:

1. Protective eyewear, comprising:

a right temple piece and a left temple piece;

at least one front piece fixed between the right temple piece and the left temple piece and configured to retain at least one lens, said front pieces having an exterior solid surface and an interior solid surface, wherein the interior solid surface faces a wearer when the eyewear is in an as-worn position and includes at least a first zone determined by a line of sight of the wearer associated with a first color and a second zone determined by the line of sight of the wearer associated with a second color, wherein the first color is defined by a first set of coordinates in a color space, the second color is defined by a second set of coordinates in the color space, and the first set of coordinates and the second set of coordinates are not the same; and a bridge fixed to the front piece.

2. The protective eyewear of claim 1, said right temple piece and left temple pieces having an exterior solid surface and an interior solid surface, wherein the interior solid surface of the right temple piece includes at least one third zone determined by a line of sight of the wearer associated with a third color and the interior solid surface of the left temple piece includes at least one fourth zone determined by a line of sight of the wearer associated with a fourth color, wherein the third color is defined by a first set of coordinates in the color space, and the second color is defined by a second set of coordinates in the color space.

3. The protective eyewear of claim 1, further comprising pads fitted to the bridge which lay against the nose of the wearer, said pads having an interior solid surface, wherein the interior solid surface includes at least one fifth zone determined by a line of sight of the wearer associated with a fifth color and wherein the fifth color is defined by a fifth set of coordinates in the color space.

4. The protective eyewear of claim 1, wherein the first and second zones are substantially horizontal in an as-worn position.

5. The protective eyewear of claim 1, wherein the interior solid surface of the frame includes a sixth zone determined by the line of sight of the wearer associated with a sixth color defined by a sixth set of coordinates in the color space plot.

6. The protective eyewear of claim 5, wherein the first, second, and sixth set of coordinates are associated with brown, green, and grey, respectively.

7. The protective eyewear of claim 1, wherein the exterior solid surface of the frame includes a first exterior zone and second exterior zone associated with the first and second set of coordinates, respectively.

8. The protective eyewear of claim 1, wherein the exterior solid surface of the frame is associated with an exterior visual characteristic.

9. The protective eyewear of claim 8, wherein the exterior visual characteristic is associated with at least a seventh set of coordinates in the color space plot and wherein the seventh set of coordinates corresponds to a color approximating the skin tone of the wearer.

10. The protective eyewear of claim 1, wherein the line of sight of the wearer corresponds to a line of sight of a playing field for a sport and the first color and second color are associated with colors based on the line of sight of the playing field of the sport.

11. Eyewear comprising:

at least one front piece fixed between a right temple piece and a left temple piece;

the at least one front piece configured to retain at least one lens, said front pieces having an exterior solid surface and an interior solid surface, wherein the exterior solid surface faces away from a wearer when the eyewear is in an as-worn position and is associated with an exterior visual characteristic, and wherein the interior solid surface faces towards the wearer when the eyewear is in the as-worn position and includes at least a first zone determined by a line of sight of the wearer of a playing field for a sport associated with a first color and a second zone determined by the line of sight of the wearer of the playing field for the sport associated with a second color, wherein the first color is defined by a first set of coordinates in a color space, the second color is defined by a second set of coordinates in the color space, and the first set of coordinates and the second set of coordinates are not the same;

a bridge fixed to the at least one front piece; and the right temple piece and the left temple piece having an exterior solid surface and an interior solid surface, wherein the interior solid surface of the right temple piece includes at least one third zone determined by a line of sight of the wearer of the playing field for the sport associated with a third color and the interior solid surface of the left temple piece includes at least one fourth zone determined by a line of sight of the wearer of the playing field for the sport associated with a fourth color, wherein the third color is defined by a first set of coordinates in the color space, and the second color is defined by a second set of coordinates in the color space.

12. The eyewear of claim 11, further comprising pads fitted to the bridge which lay against the nose of the wearer, said pads having an interior solid surface, wherein the interior solid surface of the pads includes at least one fifth zone determined by a line of sight of the wearer associated with a fifth color and wherein the fifth color is defined by a fifth set of coordinates in the color space.

13. The eyewear of claim 11, wherein the first and second zones are substantially horizontal in the as-worn position.

14. The eyewear of claim 11, wherein the exterior visual characteristic is associated with a sixth set of coordinates in the color space plot and the sixth set of coordinates corresponds to a color approximating the skin tone of the wearer.

15. The eyewear of claim 11, wherein the interior solid surface of the frame includes a seventh zone determined by the line of sight of the wearer of the playing field for the sport associated with a seventh color defined by a seventh set of coordinates in the color space plot.

16. The eyewear of claim 15, wherein the first, second, and seventh set of coordinates are associated with brown, green, and grey, respectively.

17. The eyewear of claim 11, wherein the exterior visual characteristic includes a first exterior zone and a second exterior zone.

* * * * *